US007784189B2

(12) United States Patent
Polei

(10) Patent No.: US 7,784,189 B2
(45) Date of Patent: Aug. 31, 2010

(54) KNIFE

(75) Inventor: Gudula Polei, Solingen (DE)

(73) Assignee: Martor KG, Solingen (DE)

( * ) Notice: Subject to any disclaimer, the term of this patent is extended or adjusted under 35 U.S.C. 154(b) by 0 days.

(21) Appl. No.: 11/792,220

(22) PCT Filed: Oct. 10, 2006

(86) PCT No.: PCT/DE2006/001777

§ 371 (c)(1),
(2), (4) Date: Jun. 1, 2007

(87) PCT Pub. No.: WO2007/042001

PCT Pub. Date: Apr. 19, 2007

(65) Prior Publication Data

US 2008/0189956 A1 Aug. 14, 2008

(30) Foreign Application Priority Data

Oct. 13, 2005 (DE) ..... 10 2005 049 411

(51) Int. Cl.
*B26B 3/06* (2006.01)
*B26B 1/08* (2006.01)

(52) U.S. Cl. ..... 30/162; 30/335; 30/340; 30/342

(58) Field of Classification Search ..... D8/99; 30/162, 329–340, 342; 606/167
See application file for complete search history.

(56) References Cited

U.S. PATENT DOCUMENTS 1,529,336 A * 3/1925 Wisniewski ..... 30/162
2,198,111 A * 4/1940 Gorbatenko et al. ..... 30/162
2,619,724 A 12/1952 Manthey et al.
3,078,572 A * 2/1963 Everton ..... 30/333
3,765,089 A * 10/1973 Ibata ..... 30/335
3,879,847 A 4/1975 Roll ..... 30/162
4,277,888 A * 7/1981 Szabo ..... 30/162
4,292,738 A * 10/1981 Osada ..... 30/162
4,663,845 A * 5/1987 Weimann ..... 30/162

(Continued)

FOREIGN PATENT DOCUMENTS

CH 547 686 4/1974

(Continued)

*Primary Examiner*—Jason Daniel Prone
(74) *Attorney, Agent, or Firm*—Andrew Wilford

(57) ABSTRACT

Disclosed is a knife comprising a housing (11) with a blade fixture (12) which can be moved translationally in the longitudinal direction (x) of the housing within a receiving duct (A) of the housing (11). The blade fixture (12) accommodates the knife blade (13) between a first blade contact surface (38) and a second blade contact surface (31) in a closed position while an operator's attachment (14) is assigned to the base (G) and/or the blade locking mechanism (19) in order to translationally move the blade fixture (12). The operator's attachment (14) is retained on the base (G) outside the blade locking mechanism (19). Inner surfaces (35*a*, 35*b*) that border the blade fixture (12) and are located in the receiving duct (A) retain the locking mechanism (19) in the closed position in which the locking mechanism (19) rests against the base (G), or release the locking mechanism (19) in order to open the locking mechanism (19) and remove the blade when the locking mechanism (19) is moved forward and outward through the blade through-hole (37) into a blade replacement position.

12 Claims, 6 Drawing Sheets

U.S. PATENT DOCUMENTS

| | | | | | |
|---|---|---|---|---|---|
| 4,769,912 | A * | 9/1988 | Davis | 30/162 |
| 4,835,865 | A | 6/1989 | Knoop | |
| 5,168,630 | A * | 12/1992 | Weber | 30/330 |
| 5,203,085 | A * | 4/1993 | Berns | 30/163 |
| 5,330,493 | A * | 7/1994 | Haining | 606/167 |
| 5,371,948 | A * | 12/1994 | Liffiton | 30/163 |
| 5,426,855 | A * | 6/1995 | Keklak et al. | 30/162 |
| 5,511,311 | A * | 4/1996 | Collins | 30/162 |
| 5,581,890 | A * | 12/1996 | Schmidt | 30/162 |
| 5,644,843 | A * | 7/1997 | Young | 30/162 |
| 5,735,051 | A * | 4/1998 | Berns | 30/333 |
| 6,161,290 | A * | 12/2000 | Takamasa | 30/162 |
| 6,233,832 | B1 * | 5/2001 | Berns | 30/162 |
| 6,550,144 | B1 * | 4/2003 | Berns | 30/162 |
| 6,813,833 | B2 * | 11/2004 | Saunders et al. | 30/162 |
| 6,854,187 | B2 * | 2/2005 | Huan | 30/339 |
| 6,907,668 | B2 * | 6/2005 | Polei | 30/162 |
| D516,403 | S * | 3/2006 | Ping | D8/99 |
| 7,028,406 | B2 * | 4/2006 | Polei | 30/162 |
| 7,340,836 | B2 * | 3/2008 | Whitemiller et al. | 30/162 |
| 7,540,092 | B2 * | 6/2009 | Polei | 30/162 |
| D598,728 | S * | 8/2009 | Polei | D8/99 |
| 7,647,702 | B2 * | 1/2010 | Polei | 30/162 |
| 2003/0037444 | A1 * | 2/2003 | Chunn | 30/337 |
| 2007/0056170 | A1 * | 3/2007 | Rowlay | 30/162 |
| 2007/0119056 | A1 * | 5/2007 | Polei | 30/162 |
| 2007/0277382 | A1 * | 12/2007 | Okada | 30/162 |
| 2009/0113725 | A1 * | 5/2009 | DeLillo | 30/335 |
| 2009/0255129 | A1 * | 10/2009 | Gringer et al. | 30/162 |

FOREIGN PATENT DOCUMENTS

| | | | |
|---|---|---|---|
| DE | 20 2005 003 823 | U1 | 8/2005 |
| DE | 10 2005 049 411 | B3 | 3/2007 |
| EP | 244517 | A1 * | 11/1987 |
| EP | 1479487 | A1 * | 11/2004 |
| JP | 2007117749 | A * | 5/2007 |
| JP | 2007144196 | A * | 6/2007 |
| WO | WO 2007042001 | A1 * | 4/2007 |

* cited by examiner

IV
IV
10
11a
17
37
21
13
30
32a
33a 24b
24a
11b
11a
40
39
14
A
12
32b
32a
33b
33a
25
b
G
38
31
19
11a
35a
35b
36
30
23
37
34
18
13
x2
x1
y1
y2

KNIFE

CROSS REFERENCE TO RELATED APPLICATIONS

This application is the US national phase of PCT application PCT/DE2006/001777, filed 10 Oct. 2006, published 19 Apr. 2007 as WO2007/042001, and claiming the priority of German patent application 102005049411.0 itself filed 13 Oct. 2005, whose entire disclosures are herewith incorporated by reference.

FIELD OF THE INVENTION

The invention relates to a knife with a housing and with a blade holder received in a passage of the housing such that it can be moved in a straight line in the housing longitudinal direction so that the knife blade on the one hand can be pushed forward through a blade hole and on the other hand can be retracted into the interior of the housing in a closed position, the blade holder receiving the knife blade between a first blade-gripping surface of a base body and a second blade-gripping surface of a blade latch part that is detachably held on the base body, an operating element being associated with the base body and/or the blade latch part for straight-line displacement of the blade holder

BACKGROUND OF THE INVENTION

Such a knife is known from DE 36 22 343 [U.S. Pat. No. 4,835,865]. The known knife has a housing in which a slide is slidably guided. The slide is provided with a cover, the knife blade being held between the base body of the slide and the cover. For actuating the slide, a longitudinal slide slot is provided laterally on the housing. When the slide is in the non-use position, the knife blade can be inserted through the longitudinal slide slot into the slide, in which the cover of the slide can be opened outward transverse to the blade advance direction and parallel to the transverse axis of the handle. The cover also forms the actuating element for the slide.

This knife, which is otherwise advantageous, can be improved in that the structural design of the knife is subject to limits. In particular, for changing the blade the longitudinal slide slot must be made large enough to enable the blade to pass through. Also, the knife can be improved in terms of manageability when changing the blade.

OBJECT OF THE INVENTION

Proceeding from the above-described prior art, it is the object of the invention to create a knife with improved manageability along with high occupational safety.

SUMMARY OF THE INVENTION

The object is attained in that the operating element is held outside the blade latch part on the base body, inner surfaces adjacent the blade holder mounted in the passage holding the latch part in its closed position adjacent the base body, or, when the latch part is pushed forward through the knife blade through opening and out into a blade-change position, is released for opening the latch part and removing the knife blade.

The essential principle of the invention is consequently comprised in that the operating element is held outside the blade latch part on the base so that inner surfaces of the passage that are adjacent the blade holder act as control surfaces for the latch part. When the blade holder is in the non-use position or in the working position, the inner surfaces of the passage hold the latch part in its closed position. However, if the latch part is pushed forward and out through the knife blade hole into the blade changing position, at least some of the blade holder loses contact with the inner surfaces of the passage so that it is possible to open the latch part and remove the knife blade.

The invention has the essential advantage that it is very simple to change the blade. The free space in the housing is clearly increased. With the inventive solution it is no longer necessary to provide a longitudinal slot in the housing that is used for changing the blade. On the contrary, the invention makes it possible to provide only very small openings for the operating element in the housing, which prevents dirt from getting into the housing this way.

In accordance with a first embodiment, the operating element is held on an end on the base body turned away from the blade hole. The operating element can be attached on a narrow side of the blade holder opposite the blade holes. In this manner the inner surfaces of the passage can act as guide and control surfaces for the outer surfaces of the blade holder.

In accordance with another embodiment, the latch part is pivotal on the blade holder. With the pivotal mounting of the latch part, folding from the base body is possible, the latch part being always permanently held on the base. Moreover, the pivotal mounting permits the blade to be changed without the blade latch part having to be moved completely out of the passage of the housing.

In accordance with another embodiment of the invention, the pivot axis of the latch part is oriented transverse to the displacement direction of the blade holder. When the pivot axis is oriented in this manner, it is sufficient when only part of the latch part is moved out of the passage. The latch part can be pivotal through an acute angle, the latch part being spaced from the base body in the front area of the blade holder such that it is possible to change the blade.

In accordance with another embodiment, the pivot axis of the latch part is oriented parallel to the displacement direction of the blade holder. The latch part cannot be spaced from the base body until the latch part has been moved completely out of the passage.

In accordance with another embodiment of the invention, the latch part has a contact element that projects with respect to the outer surface adjacent thereto and the outer surface of which, when the knife is in a non-use position or a cutting position, cooperates with an inner surface of the passage, holding the latch part to the base, while in the blade-change position the outer surface is not in contact with the inner surface of the passage. The contact element corresponds to the inner surface of the housing and thus holds the latch part tightly to the base body when in the non-use and in the cutting position, while when in the blade-change position the contact element is no longer guided by the inner surface of the housing and thus permits the latch part to be folded.

In accordance with another embodiment of the invention, the contact element is mounted on a front end of the blade holder. Using this embodiment, the blade holder must merely be moved slightly out of the passage so that it is possible to spread the latch part from the base body and thus to change the blade.

In accordance with another embodiment, the latch part of the blade holder or the inner surface of the passage has a lever element that, when in the blade-change position, cooperates with a countersurface associated with the inner wall of the passage or with the latch part to spread the latch part from the base. Using this embodiment, as well, it is possible to save the use of a spring element. In the blade-change position, when the lever element engages an inner wall area of the passage, the lever action causes the latch part to automatically pivot into its open position.

In accordance with another embodiment, the lever element is formed by a pin and the countersurface by a groove with a ramp-like groove bottom. In the non-use and cutting positions, the pin is positioned at the higher part of the ramp and prevents the latch part from spreading apart from the base. In contrast, in the blade-change position the pin is moved into the lower part of the ramp. The latch part thus has sufficient room to be able to separate from the base. In the blade-change position, the pin engages the side wall of the groove end area and forces the latch part to move away from the base.

In accordance with another embodiment, the lever element is formed by an arm joined to the latch part and the countersurface is formed by a stop surface associated with the inner wall of the passage. The arm can be unitary with the latch part. In the blade-change position, the arm can engage for instance a stop surface on the housing and cause the latch part to pivot so that it spreads from the base.

In accordance with another embodiment of the invention, a safety element that can be moved between a safety position and a release position can prevent the blade holder from moving into the blade-change position. Inadvertent positioning in the blade-change position can be prevented using the safety element. Thus it is possible to work with the knife safely without the risk of an unintentional movement into the blade-change position. The safety element can be formed for instance by a stop that is associated with a lever. The stop can be pivoted to move into the movement path or out of the movement path of the blade holder. If the stop is in the movement path of the blade holder, the latter can only be moved into the cutting position. In contrast, if the stop is moved out of the movement path of the blade holder, the blade holder can be moved into the blade-change position.

In accordance with another embodiment of the invention, the blade holder has a spring element that biases the latch part in the opening direction. In the blade-change position, the latch part is thus automatically spaced apart from the base body by the spring element.

In accordance with another embodiment of the invention, the latch part is formed by an elastic material, the resilient restoring force of the material biasing the latch part in the opening direction. When the latch part is placed against the base, the material of the latch part is stressed and it can relax again when the latch part is in the blade-change position so that the latch part moves away from the base.

BRIEF DESCRIPTION OF THE DRAWING

Additional advantages of the invention result from the subordinate claims that were not cited and from the illustrated embodiments in the drawings in conjunction with the following description.

SPECIFIC DESCRIPTION

Figure 1:
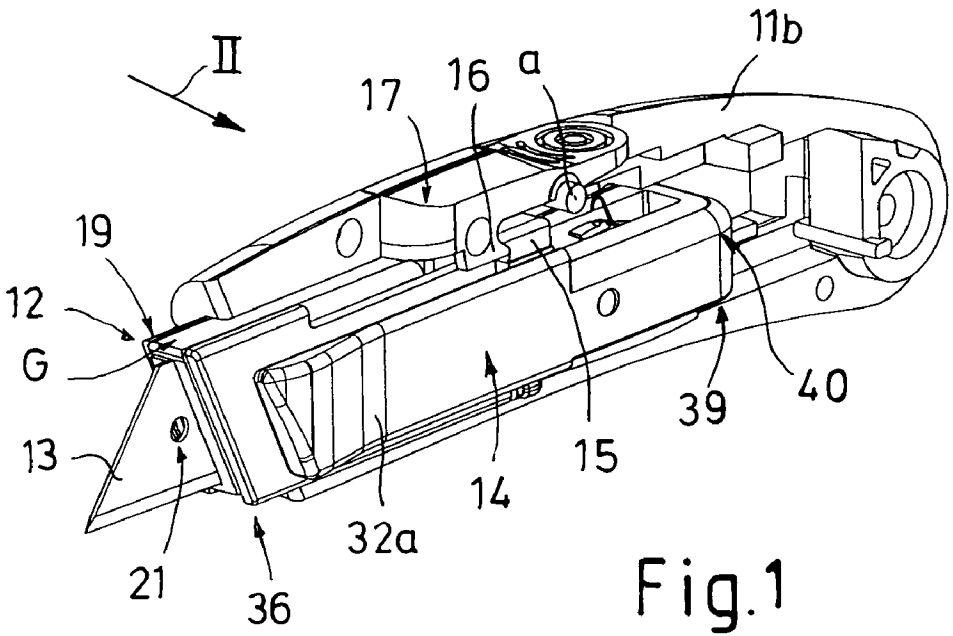
FIG. 1 is a perspective view of the inventive knife in the cutting position, one of the two housing halves not shown.
Figure 2:
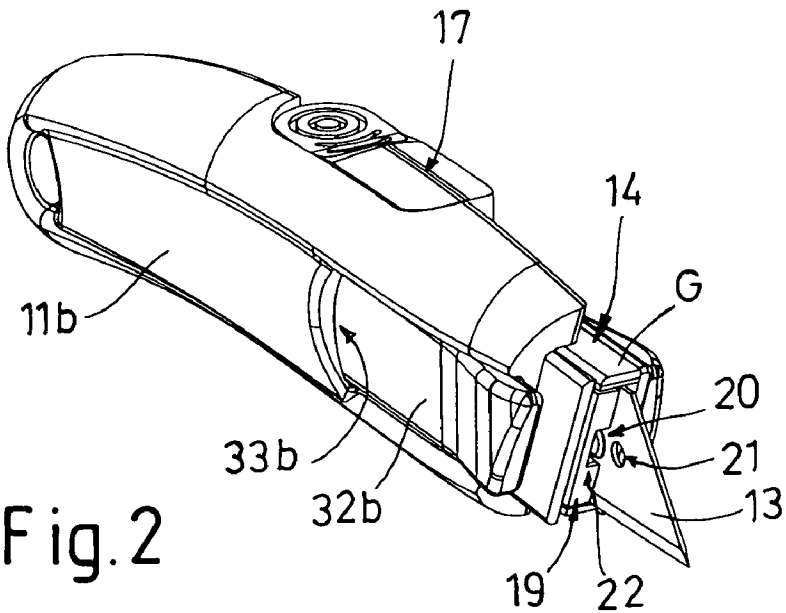
FIG. 2 is a perspective view of the knife from approximately the viewing angle shown at II in FIG. 1.
Figure 3:
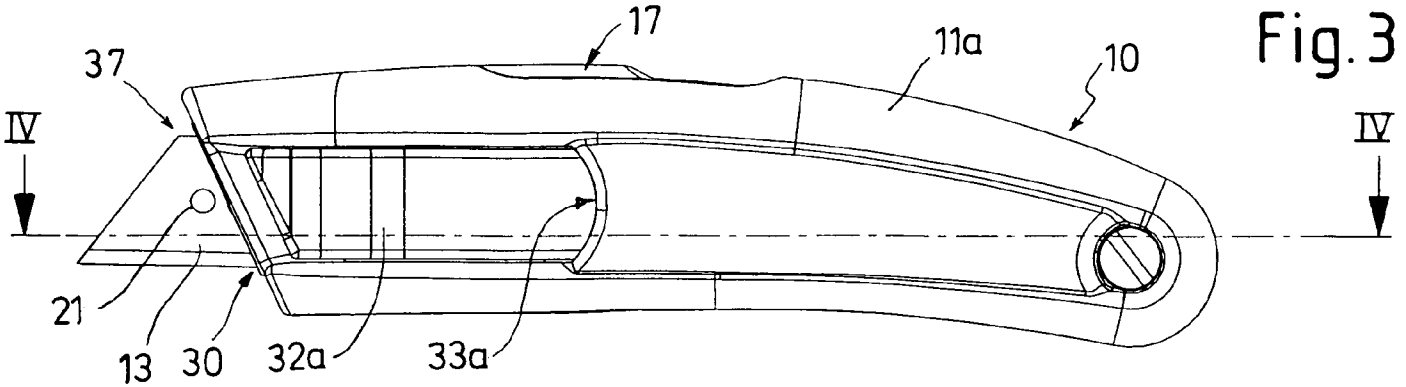
FIG. 3 is a side view of the knife in the cutting position.

In accordance with FIG. 1, a knife 10 essentially has a housing 11*a*, 11*b*, a blade holder 12 with a blade 13, and an operating element 14. The housing comprises two housing halves 11*a* and 11*b*, only the housing half 11*b* being depicted in FIG. 1 for reasons of clarity.

The operating element 14 is U-shaped, free legs 32*a* and 32*b* being joined by a crosspiece 40. The crosspiece 40 of the operating element 14 is attached to a rear end 39 of the blade holder 12. The legs 32*a* and 32*b* project out of an opening 33*a* of the housing half 11*a* and out of an opening 33*b* of the housing half 11*b*. The operating element 14 thus permits both right-handed and left-handed people to use the knife 10.

The blade holder 12 is received in a passage A of the housing 11 such that it can be moved longitudinally in a straight line. The passage is largely defined by inner surfaces 35*a* and 35*b* of the housing halves 11*a* and 11*b*. Starting from the non-use position in accordance with FIG. 6, the blade holder 12 can be moved, against the force of two coil springs 24*a* and 24*b* (not shown, merely indicated in FIG. 4 by dot-dash lines) that are each attached at one end directly to the housing 11 and at the other end to the blade holder 12, out of the non-use position in accordance with FIG. 6 into the cutting position in accordance with FIGS. 1 through 5. The cutting position is reached when, as shown in FIG. 5, a hook 15 of the blade holder 12 engages a stop 16 of a rocker 17. In this manner the stop 16 prevents the blade holder 12 from moving out beyond the cutting position in the direction x1. In the cutting position, the blade 13 passes through a blade hole 37 in the housing 11.

Figure 4:
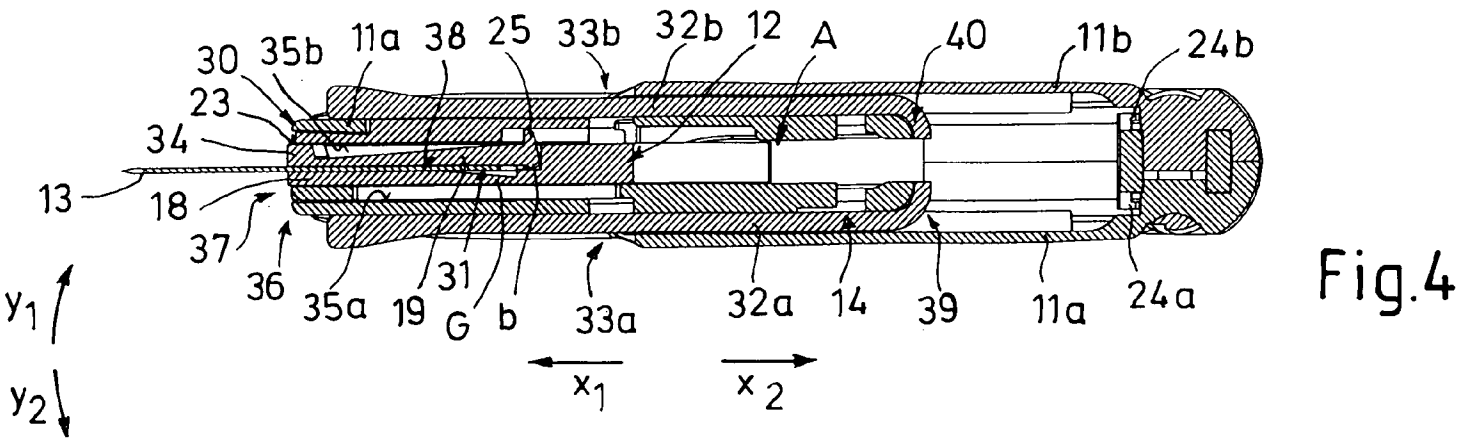
FIG. 4 is a sectional view of the knife taken along section line IV-IV of FIG. 3.
Figure 5:
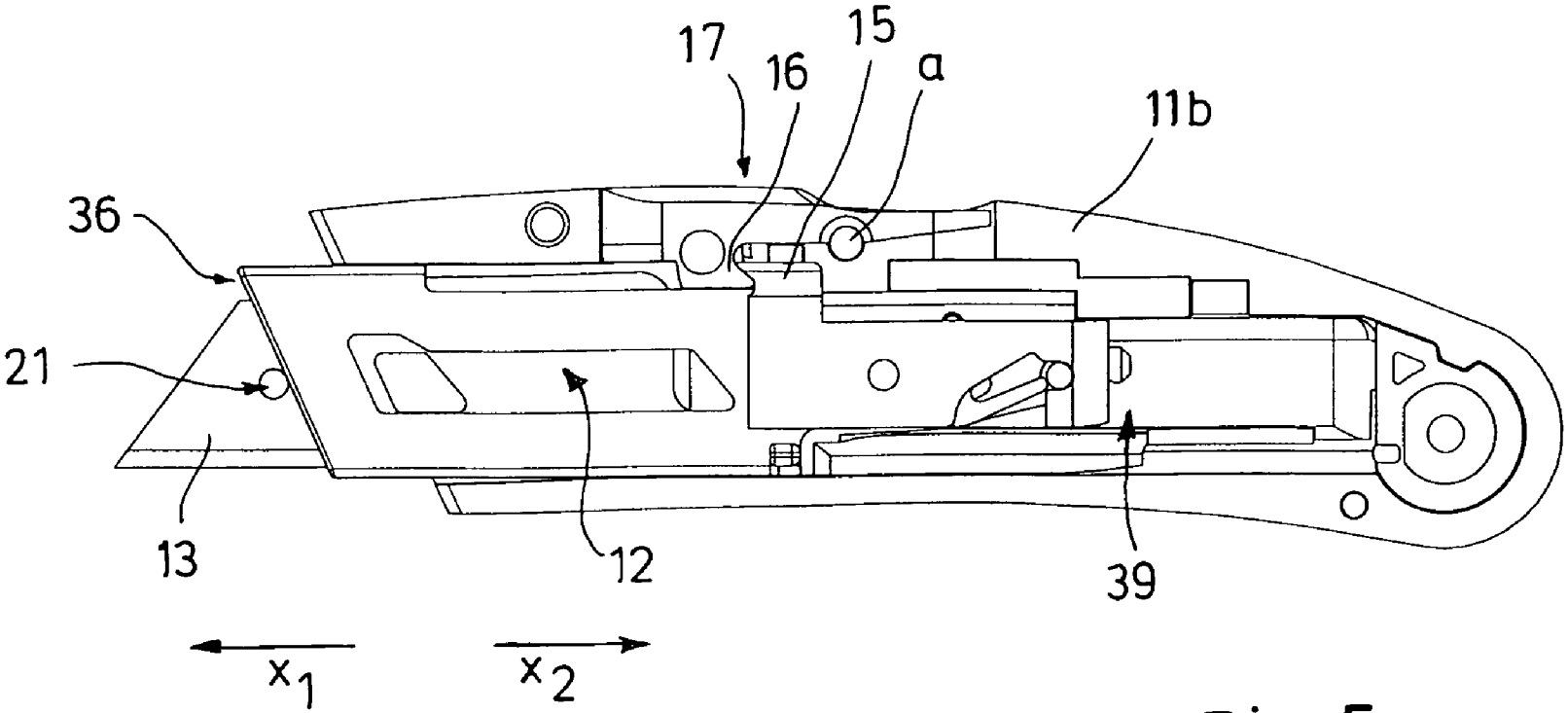
FIG. 5 is a side view of the knife in accordance with FIG. 1, one of the two housing halves not shown.

In accordance with FIG. 4, the blade 13 is held in a press and form fit between an inner surface 38 of a wall area 18 of the base body G of the blade holder 12 and an inner surface 31 of a latch part 19 that is pivotally mounted on the blade holder 12. The wall area 18 has pins 20 that fit complementarily with and pass through recesses 21 (FIG. 2) in the blade 13. In order to enhance the force-fit and form-fit mounting of the blade 13, the latch part 19 is provided with a seat 22 for the pins 20.

At a front end 36, the latch part 19 is provided with a collar 34. In both the non-use position in accordance with FIG. 6 and in the cutting position in accordance with FIGS. 1 through 5 and in all positions of the blade holder 12 therebetween a contact surface 23 of the collar 34 is positioned against the inner surface 35*b* of the housing 11*b* and prevents the latch part 19 from spreading in a direction y1 from the base body G of the blade holder 12.

Figure 7:
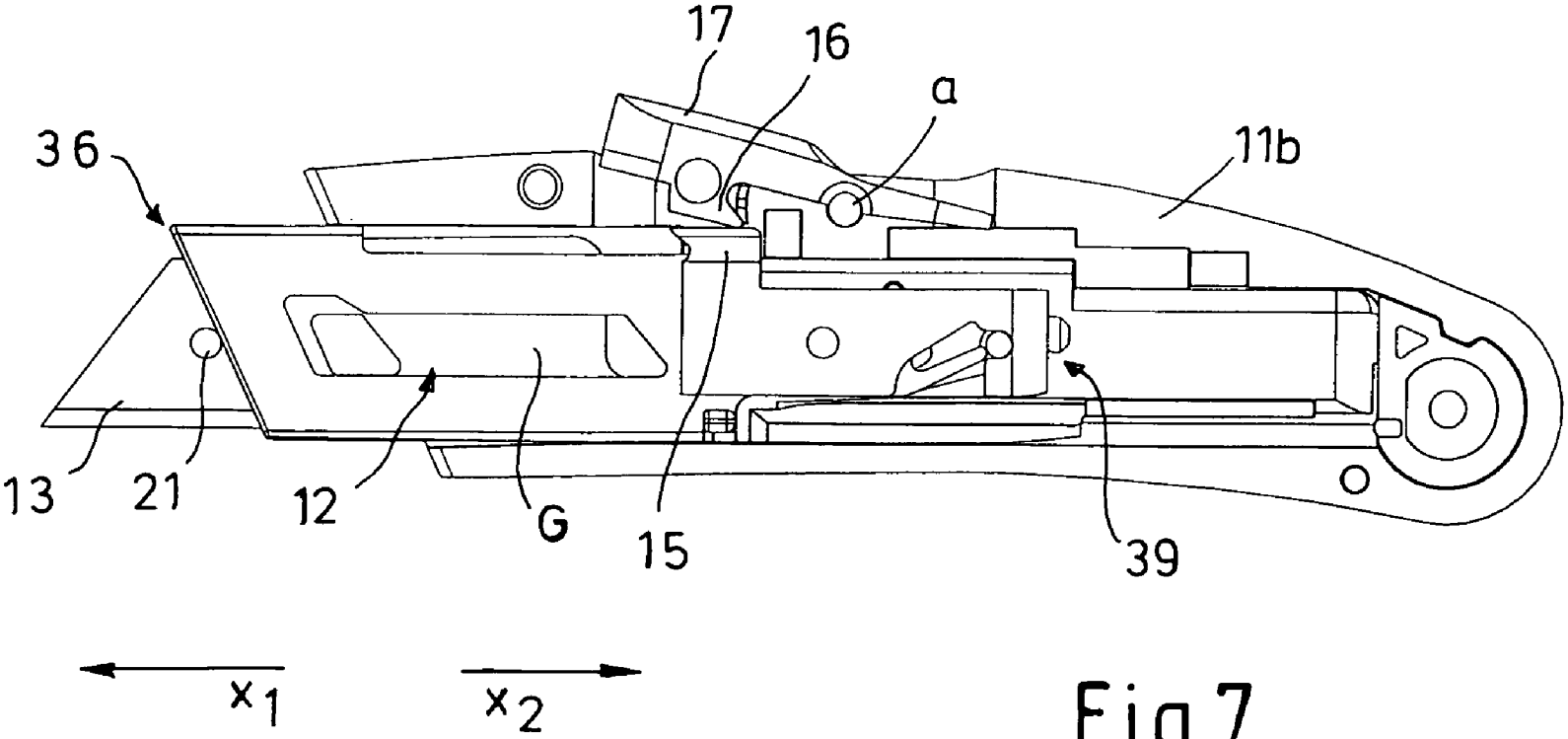
FIG. 7, like the view of FIGS. 5 and 6, is a side view of the knife in the blade-change position.
Figure 8:
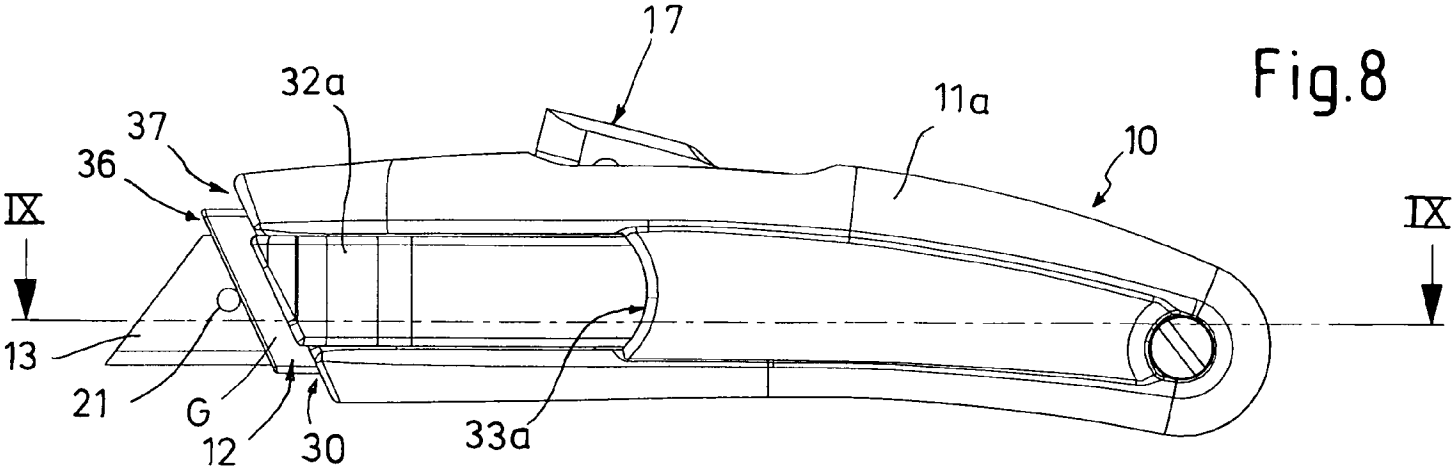
FIG. 8, like the view of FIG. 3, is a side view of the inventive knife in the blade-change position.
Figure 9:
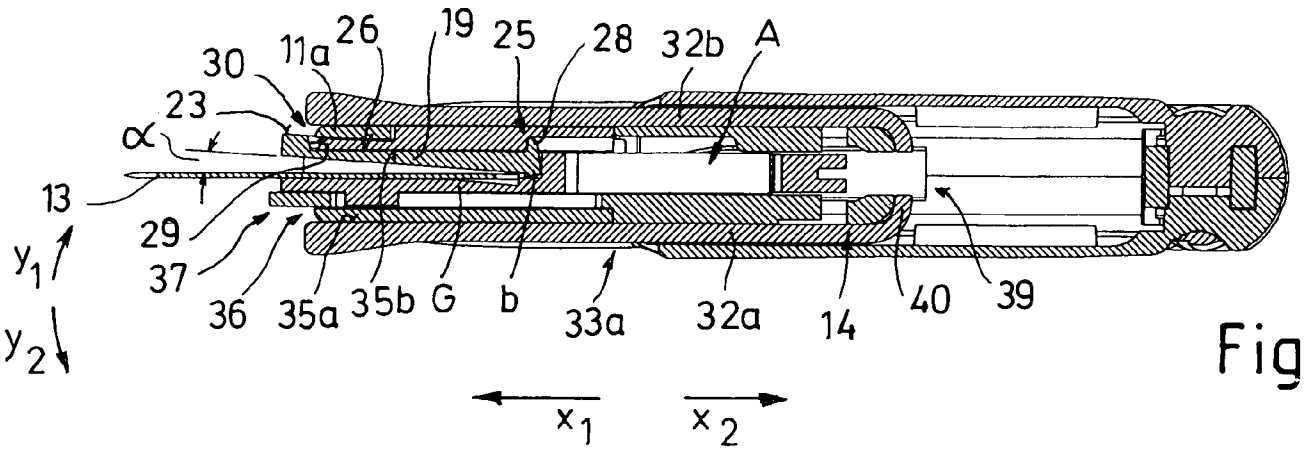
FIG. 9 is a sectional view of the knife taken along section line IX-IX of FIG. 8.

The blade can be changed as follows:

By pivoting the rocker 17 about the pivot axis a, the stop 16 of the rocker 17 can be moved out of the path of the hook 15 of the blade holder 12. The blade holder 12 can then be moved out past the cutting position of FIGS. 1 through 5 into the blade-change position of FIGS. 7 through 9, the collar 34 leaving the passage A and losing contact with the inner surface 35*b* of the housing half 11*b*.

In the blade-change position, a lever arm 25 extending at an acute angle to the longitudinal axis and unitary with the latch part 19 engages a stop surface 28 (see FIG. 9) of the housing 11*b* and thus makes the latch part 19 rotate about its pivot axis b in the direction y1 until an outer wall 26 of the latch part 19 bears against the inner surface 35*b*. The latch part 19 is thus pivoted away from the wall area 18 of the base body G about an angle α, which makes it possible to lift the blade 13 from the pins 20 and change the blade. The latch part 19 is formed by an elastic material whose resilient restoring force biases the latch part 19 in the direction y1.

Once the blade has been changed, by releasing the force on the operating element 14 the blade holder 12 is retracted in the direction x2 into the housing 11 by the coil springs 24. Because of the movement in the direction x2, the lever arm 25 is no longer positioned against the stop surface 28 of the housing 11 so that the latch part 19 can pivot back in direction y2.

The blade holder 12 moving rearward in the direction x2 closes the latch part 19 by means of an inclined surface 29 (FIG. 9) on the collar 34 that cooperates with a leading edge 30 of the housing 11 such that a force acts on the latch part 19 in the closing direction y2 until the inner surface 31 of the latch part 19 is again pressed against the base body G. The blade 13 is then gripped again between the inner surface 31 of the latch part 19 and the inner surface 38 of the base body G. When the blade holder 12 is further retracted into the housing 11, the contact surface 23 of the projection 34 comes back into contact with the inner surface 35*b* of the housing 11*b* so that the latch part 19 is prevented from opening.

Figure 6:
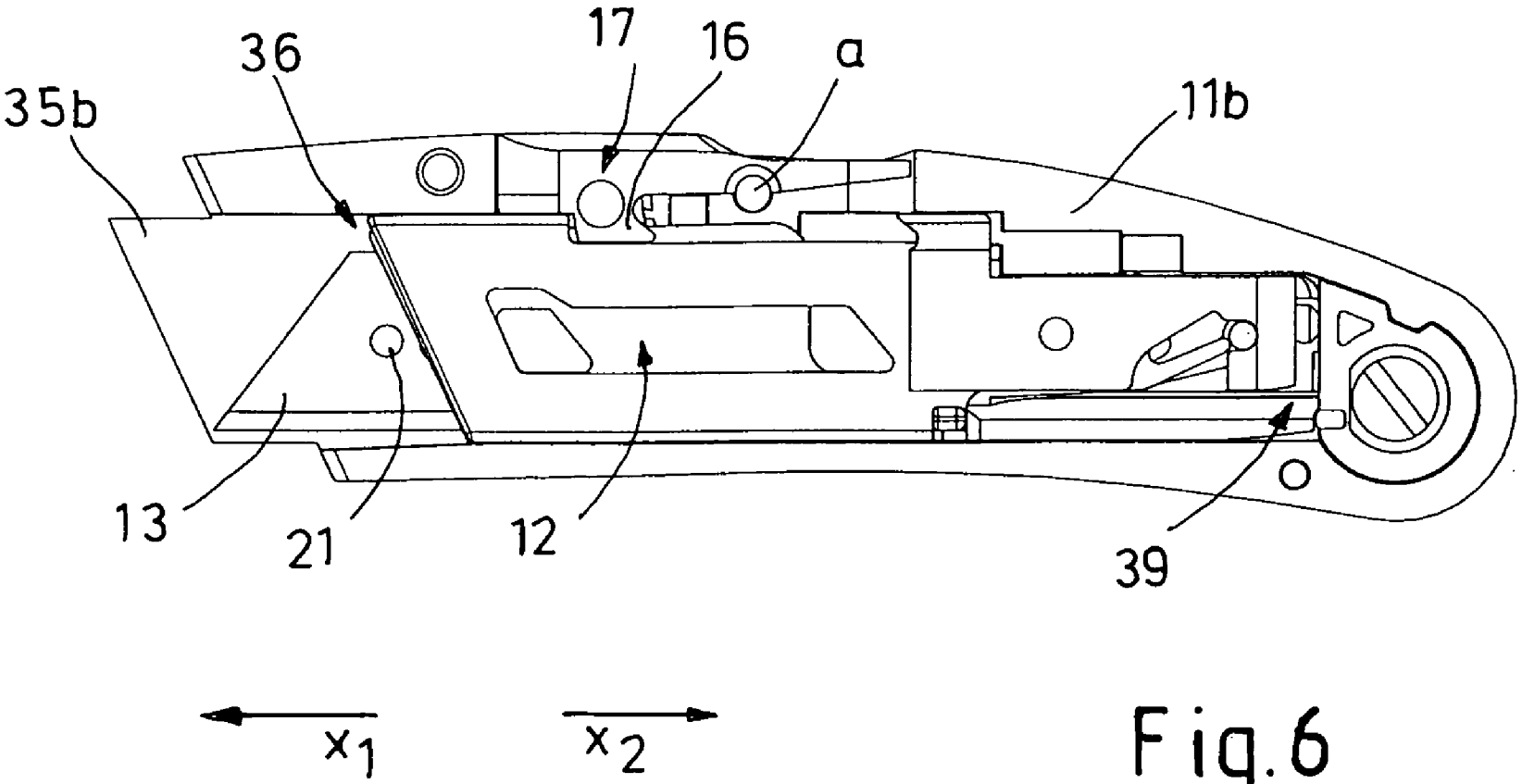
FIG. 6, like the view of FIG. 5, is a side view of the knife but in the non-use position.

Once the blade holder 12 has been moved into the non-use position in accordance with FIG. 6, the rocker 17 can be pivoted back into a position in accordance with FIGS. 1 through 5, the stop 16 moving back into the movement path of the hook 15. It is thus no longer possible to move the blade holder beyond the cutting position in the direction x1.

The invention claimed is:

1. A knife comprising:

an elongated housing having a front end and formed with a longitudinally extending passage that has a pair of confronting inner surfaces and that opens at the front end;

a blade holder longitudinally shiftable in the passage between a front blade-change position projecting past the front end and a rear position, the blade holder having a base-body with a inner face, and a latch part having a inner face and displaceable relative to the base-body between a holding position closely juxtaposed with the base-body inner face and a releasing position spaced from the base-body inner face;

an operating element connected to the holder and exposed through the housing for actuation of the holder from outside the housing; and a blade between the inner faces of the blade holder and gripped thereby in the holding position of the latch part, the inner surfaces of the housing being spaced and shaped such that they bear inwardly on the latch part and the base body when the blade holder is rearward of the front blade-change position to hold the latch part in the holding position but in the blade-change position allow the latch part to move into the releasing position.

2. The knife in accordance with claim 1 wherein the operating element is attached to a rear end of the base body.

3. The knife in accordance with claim 1 wherein the latch part is pivotal on the blade holder.

4. The knife in accordance with claim 3 wherein a pivot axis of the latch part extends transverse to a longitudinal displacement direction of the blade holder.

5. The knife in accordance with claim 1 wherein the latch part has a projecting contact element that, when the blade holder is in the rear position, a cutting position between the blade-change and rear positions, or any position between the rear position and the cutting position cooperates with one of the inner surfaces of the passage to press the latch part toward the base body and into the holding position, whereas when the blade holder is in the blade-change position the contact element is not in contact with the one inner surface of the passage.

6. The knife in accordance with claim 5 wherein the contact element is on a front end of the latch part.

7. The knife in accordance with claim 1 wherein the latch part has a lever element that, when the blade holder is in the blade-change position, cooperates with a countersurface of the one inner surface of the passage spread the latch part from the base body into the releasing position.

8. The knife in accordance with claim 7 wherein the lever element is an arm joined to the latch part and the countersurface is a stop surface of the one inner surface of the passage.

9. The knife in accordance with claim 1, further comprising a safety element on the housing movable between a safety position blocking movement of the blade holder into the blade-change position past a cutting position between the blade-change and rear position and a release position permitting movement of the blade holder into the blade-change position.

10. The knife in accordance with claim 9 wherein the safety element is a rocker.

11. The knife in accordance with claim 1 wherein the blade holder has a spring that biases the blade holder rearwardly into the rear position.

12. The knife in accordance with that claim 1 wherein the latch part is formed by an elastic material having resilient restoring force urges the latch part into the releasing position.

* * * * *